United States Patent [19]

Kaburagi et al.

[11] 4,130,389

[45] Dec. 19, 1978

[54] NOX DEPRESSION TYPE BURNERS

[75] Inventors: Katsuhiko Kaburagi; Yasutaka Yamamoto, both of Wakayama; Yutaka Suzuki, Amagasaki, all of Japan

[73] Assignee: Sumitomo Metal Industries Limited, Osaka, Japan

[21] Appl. No.: 762,238

[22] Filed: Jan. 25, 1977

[51] Int. Cl.[2] ..... F23M 9/00

[52] U.S. Cl. ..... 431/183

[58] Field of Search ..... 431/182, 183, 184, 185, 431/186, 187, 188, 189; 239/399, 405, 406

[56] References Cited

U.S. PATENT DOCUMENTS

| | | | |
|---|---|---|---|
| 2,119,952 | 6/1938 | Engels | 431/189 X |
| 2,124,175 | 7/1938 | Zink | 431/184 X |
| 2,325,442 | 7/1943 | Vroom | 431/183 X |
| 2,439,554 | 4/1948 | Anderson | 431/184 |
| 3,905,751 | 9/1975 | Hemsath et al. | 431/183 |

FOREIGN PATENT DOCUMENTS

| | | | |
|---|---|---|---|
| 220275 | 3/1962 | Austria | 431/183 |
| 642976 | 6/1962 | Canada | 431/184 |

*Primary Examiner*—Edward G. Favors

*Attorney, Agent, or Firm*—Watson, Cole, Grindle & Watson

[57] ABSTRACT

A burner for a furnace comprises a first pipe for delivering fuel to the furnace and a second pipe of larger diameter than the first pipe, positioned parallel with and encompassing the first pipe, which supplies air to the furnace in the annular space between the two pipes. The second pipe includes a large diameter section and a throttle section of gradually decreasing diameter which acts to speed up the air passing therethrough. In the annular space between the large diameter section of the second pipe and the first pipe is positioned a device having guide vanes which gives the air passing therethrough a swirling motion prior to acceleration in the throttle section. The burner further includes an air swirl passage between the throttle section of the second pipe and the furnace which conveys the air into the furnace. The air swirl passage also acts to convey the fuel into the furnace since the first pipe terminates prior to entry into the furnace.

7 Claims, 4 Drawing Figures

NOX DEPRESSION TYPE BURNERS

BACKGROUND OF THE INVENTION

1. Field of the Invention

The present invention relates to burners which burn liquid or gaseous fuels that are used, for example, in various kinds of furnaces, and in particular it relates to burners with a structure which makes it possible to greatly reduce the formation of nitrogen oxides (NOx) in the burning process.

2. Description of the Prior Art

It already is known that, in general, the higher the flame temperature becomes with a burner, the greater the undesired formation of nitrogen oxides (NOx) by-product. Therefore, as a method for reducing NOx formation, it has been attempted to restrain the increase in the flame temperature by a method wherein the amount of excess air is reduced, i.e., so as to approach the theoretical mixture ratio, or else the exhaust gas is recycled and mixed into combusting air.

On the other hand, it has also been recognized that a circulating swirl of combusting flame has a great effect in reducing NOx formation. As a method of operation using this technique, a construction of burner has been employed wherein a combustion gas (or furnace gas) is circulated by the injection energy of the air such that a circulating swirl is created.

In this type of this construction, however, there are drawbacks in that, for example, the structure of the burner is generally complicated. Also the section of refractory structure at a high temperature has many problems, and the heat transfer efficiency is lowered by the highly raised pressure of combusting air and the slowdown of combustion, and further B, C heavy oils are not suitable for use as fuels from a structural point of view. Thus a suitable structure which has a reduction effect on NOx gas production has not been yet devised.

An object of the present invention is to provide a burner which has a very simple structure and which reduces the generation of undesirable NOx gases.

That is to say, the first object of the present invention is the provision of a burner wherein an efficient circulating swirl phenomenon is created in a flame combustion section to markedly depress NOx gas production by injecting air while it is in swirling motion, and the second object is to the provision of a burner which has a very simple structure, which is durable and easy in its manufacture, which is durable in use or maintenance, easily inspected, and so on.

SUMMARY OF THE INVENTION

In accordance with the present invention, a NOx depression type burner comprises a fuel injection pipe provided along the center axes of the burner, an outer air injection pipe into which the fuel injection pipe is inserted so as to form an air passage in the annular space therebetween a mechanism for creating a swirling motion in the air passing through the annular air passage and provided in the interior of the air injection pipe, and a passage for injecting the air swirl produced by the mechanism into a furnace and positioned in communication with the air injection pipe.

DETAILED DESCRIPTION OF PREFERRED EMBODIMENTS

A burner which is attached to a furnace A comprises a fuel injection pipe 1 provided on the center axis of the burner and an outer air injection pipe 2 for conveying air towards the furnace, the pipe 2 encompassing the pipe 1. The air injection pipe 2 has a special configuration and structure as described below.

Figure 1:
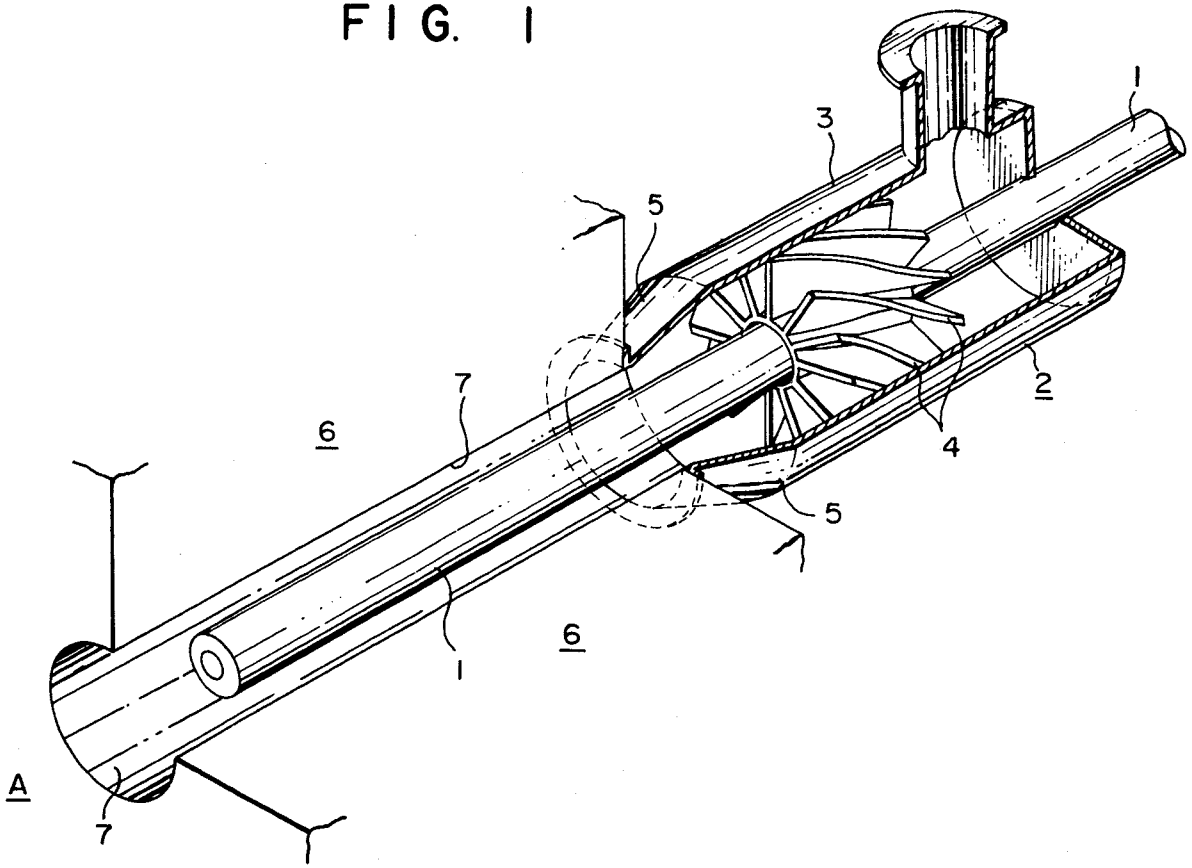
FIG. 1 is a partially cutaway perspective view of an embodiment of a burner in accordance with the present invention.
Figure 2:
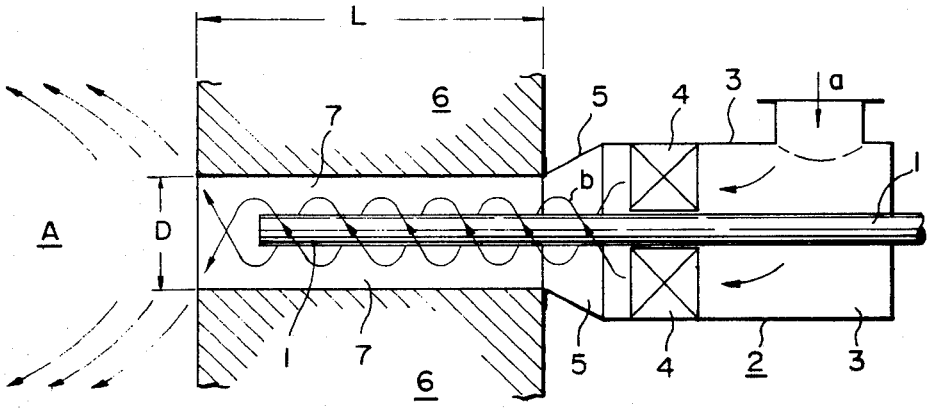
FIG. 2 is a longitudinal sectional view of FIG. 1.

That is to say, the body of the air injection pipe 2 is divided into two parts, one part being a larger diameter pipe section 3 as shown in the drawings, and defining an annular space with the fuel injection pipe 1, and a second part being a tapered throttle section 5. Within the annular space between large diameter pipe section 3 and fuel injection pipe 2 is positioned a device which includes a tubular portion and guide vanes 4. The device can either remain stationary or else rotate around pipe 2. The guide vanes 4 are formed of a plurality of curved blades by and are not only disposed in a radial fasion, but also so as to be parallel to one another. They are formed, in the axial direction of the burner, so as to cross the flow of air passing through the axial space, i.e., they are curved, at an angle of about 45° to 75° to the direction of air flow. Thus, air, which is supplied to the larger diameter pipe section 3 through suitable means at its upstream end (see arrow a in FIG. 2), is given a swirling motion as it passes through the guide vanes 4, and then it is powerfully injected toward the furnace A while swirling (see arrow b in FIG. 3). When the angle described above is less than 45°, the burner may be ignited poorly and when it is more than 75°, the loss of pressure through the vanes 4 may be increased.

The larger diameter pipe section 3 is provided with a tapering (throttle) section 5 at its outlet end so as to accelerate the air passing therethrough. The tapering ratio (i.e. the relative cross sectional areas of the small end to the diameter of the large end) is about 0.4 to 0.8 so that the fuel injection rate can be made faster than the flame transfer rate of fuel. The fuel injection rate may be varied depending upon the fuel used, but preferably is 20 to 60m/sec. Moreover, the throttle section 5 is provided at its downstream end with an air swirl passage 7 in communication therewith. The air swirl passage 7 has the same diameter D as both the small diameter end of the tapering portion 5 and that of the opening into furnace A, and is surrounded by a refractory, for example, burner tile 6. Thus the air passes through the air swirl passage 7 while swirling as the arrow b and is injected into the interior of the furnace A.

The length L of the air swirl passage 7 corresponds to about 4 times its diameter D. The fuel injection pipe is inserted into the air swirl passage 7 so that the downstream end of the pipe 1 is positioned a distance away from the opening into furnace A equal to a range of 0.1 to 4.0 times, preferably 0.5 to 1.0 times, the diameter D of the opening. In this case, the range of less than 0.1 times may deteriorate the mixing and the range of more than 4.0 times may increase the amount of NOx formed.

Figure 3:
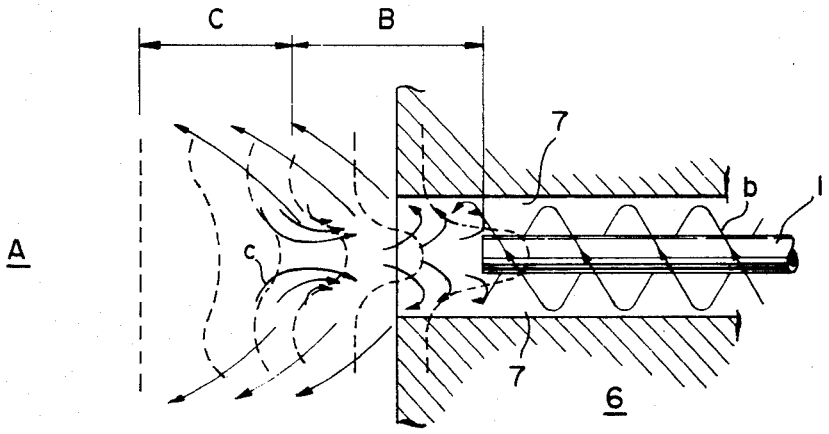
FIG. 3 is a sectional view for exaplining the action of combustion in case where the burner in accordance with the present invention is used.

Since the burner in accordance with the present invention has the structure described in the foregoing embodiment, the air which is supplied to the air injection pipe 2 as the arrow a is given a swirling motion when passing through the guide vanes 4, and then the speed of the air is increased still more while swirling as the arrow b as it passes through the throttle section 5, and finally, after passing through the air swirl passage 7, the air is injected strongly into the furnace A. Thus, as shown in FIG. 3, this air swirl produces a lower pressure part, particularly in the interior of the air swirl passage 7 and in the neighbourhood of its front opening around the axes of the air swirl to form a desirable circulating flow as an arrow c. The dotted lines in FIG. 3 represent pressure distribution lines.

Figure 4:
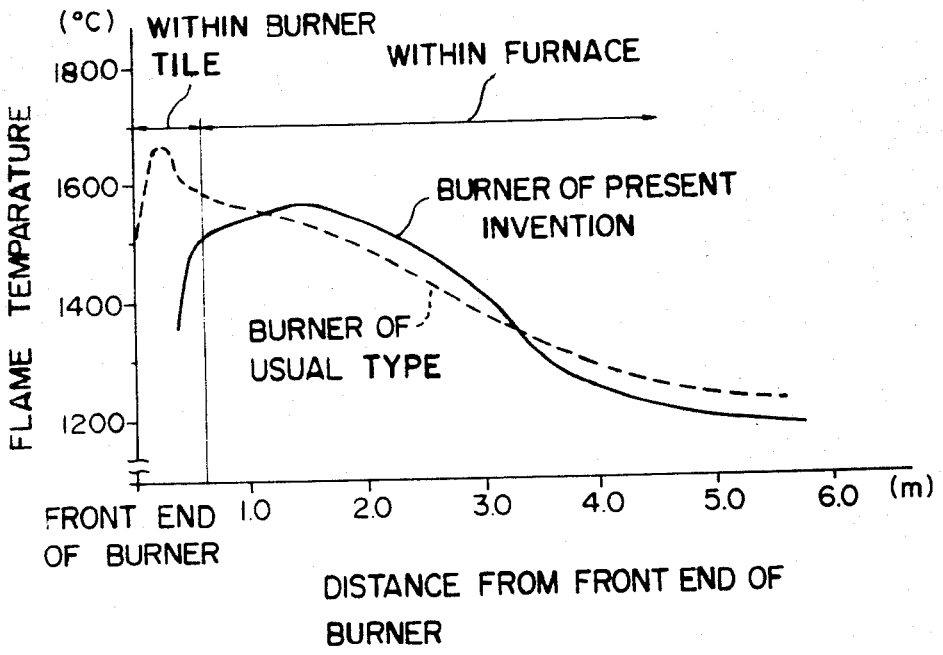
FIG. 4 is a comparative graph comparing a flame temperature pattern of the burner in accordance with the present invention with that of a conventional burner.

On the other hand, a fuel such as oil or gas which has been injected from the downstream end of the fuel injection pipe 1 into the furnace A at an angle 5° to 60° to the flowing axes, impinges against the circulating flow of high temperature combustion gas within the furnace A whereupon, in case of oil, oil particules become rapidly gaseous (or in the case of a gas, it disperses into and mixed with the air), whereupon the gas rides on the air swirl which surrounds it, and thus the combustion is started. This combustion is remarkably rapid in comparison with the usual oil combustion because the fuel has already become gaseous by the circulating flow of high temperature combustion gas. Namely, the impingement of the circulating flow of high temperature combustion gas against the fuel has a distinguishing effect upon the rapid combustion. Further, for the reason that the air swirl produces an atomized gas zone B, as shown in FIG. 3, from the downstream end of the fuel injection pipe 1 to the flame forming zone C, the combustion region does spread out in the direction of the burner axis. The flame temperature pattern of the burner in accordance with the present invention is shown in FIG. 4, and is compared with a prior art burner in the case where, for example, oil is burned.

It can be seen that in the prior art burner the temperature rises within the burner tile at its localized area and NOx gases are formed, while in accordance with the present invention the combustion begins in the interior of the furnace A after the oil leaves the air swirl passage 7 as described above. Thus it is apparent from FIG. 4 that in accordance with the present invention, the maximum flame temperature is lower by about 100° C. as compared to the prior art burner, and the area of high temperature is shifted into the interior of the furnace A, and yet the flame temperature pattern has a relatively flat and gentle characteristic. This is derived from the fact that the flame is diluted with the circulating flow of high temperature combustion gas as described above, resulting in the advantage of remarkably reducing the amount NOx gases formed by the burner.

It has been determined that the values of NOx gases formed when using the burner in accordance with the present invention as compared to the usual type burner, considering the use of oil as the combustion material, are as follows:

| Burner of | Air ratio of 1:1 | 1:2 | 1:4 |
|---|---|---|---|
| the type of present invention | 51 ppm | 62 ppm | 84 ppm |
| the usual type | 130 ppm | 180 ppm | 200 ppm |

In this table, the furnace temperature is 1250° C., fuel is Minas heavy oil, and each NOx value in ppm is converted into as 11% of $O_2$.

From this comparative table, it can be seen that the burner in accordance with the present invention forms NOx gases only about 40% of the NOx values formed by the usual type burner in every case, and therefore the present invention provides an excellent way to reduce the amount of NOx gases produced.

It can be seen that the burner in accordance with the present invention can create a desirable circulating flow of combustion gas, and therefore, can reduce nitrogen oxides produced, this being very desirable as nitrogen oxides are one of the commonest industrial polutants. In addition to this, the present invention can provide burners affording a series of good effects, for example, they are well durable, they can easily be manufactured with low cost, and they can easily be maintained and inspected, i.e., since the structure of the burners is simple. The inventive burners will afford very distinguished advantages to the manufacturing industry where various types of furnaces or boilers are used.

What we claimed is:

1. An NOx depression type burner comprising a hollow air injection pipe which has an air inlet means and an air exit opening, said hollow air injection pipe comprising two parts, one part being a large diameter straight tubular section and the other part being a tapered section, said tapered section forming at its small diameter end said air exit opening, the ratio of cross sectional areas of said small diameter end to the large diameter section ranging from 0.4 to 0.8;

a burner tile which has a constant diameter, straight tubular passage therethrough, one end of said tubular passage connectable to an opening in a furnace and the other end connected to said air exit opening of said hollow air injection pipe;

a hollow fuel injection pipe positioned to extend through the center axis of said hollow air injection pipe and the center axis of said tubular passage of said burner tile, the open end of said hollow fuel injection pipe positioned a predetermined distance inwardly of said burner tile from the end of said tubular passage connectable to an opening in a furnace, means positioned in the annular space between said hollow air injection pipe and said fuel injection pipe to cause air passing through said annular space from the air inlet means of said air injection pipe to said air exit opening to swirl;

said predetermined distance being in a range of 0.1 to 4.0 times the diameter of said straight tubular passage.

2. The burner of claim 1 wherein said means for causing air passing through said hollow air injection pipe and said fuel injection pipe to swirl comprises a device which includes a plurality of parallel guide vanes which are angled along the axial direction of the air injection pipe.

3. The burner of claim 2 wherein said angle is 45° to 75°.

4. The burner of claim 2 wherein said device includes a tubular portion positioned around said air injection pipe which allows said device to rotate therearound, and said plurality of guide vanes are connected in radial fashion to said tubular portion.

5. The burner of claim 1 wherein said predetermined distance is equal to about 0.5 to 1.0 of the diameter of said straight tubular passage in said burner tile.

6. The burner of claim 1 wherein the air injection rate in said straight tubular passage is faster than the flame transfer rate.

7. The burner of claim 1 wherein the injection rate of air swirl in said straight tubular passage is 20 to 60 meters/second.

* * * * *

UNITED STATES PATENT OFFICE

CERTIFICATE OF CORRECTION

PATENT NO. : 4,130,389

DATED : December 19, 1978

INVENTOR(S) : Katsuhiko Kaburagi et al

It is certified that error appears in the above-identified patent and that said Letters Patent are hereby corrected as shown below:

[30] FOREIGN APPLICATION PRIORITY DATA

January 26, 1976 Japan..... 51-7699

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*